United States Patent [19]

Mongia et al.

[11] Patent Number: 4,532,762

[45] Date of Patent: Aug. 6, 1985

[54] GAS TURBINE ENGINE VARIABLE GEOMETRY COMBUSTOR APPARATUS

[75] Inventors: Hukam C. Mongia; Edwin B. Coleman, both of Tempe; Thomas W. Bruce, Pheonix, all of Ariz.

[73] Assignee: The Garrett Corporation, Phoenix, Ariz.

[21] Appl. No.: 400,580

[22] Filed: Jul. 22, 1982

[51] Int. Cl.[3] ..... F02C 7/00

[52] U.S. Cl. ..... 60/39.23; 60/748; 60/757

[58] Field of Search ..... 60/39.02, 39.23, 39.36, 60/748, 755, 756, 757

[56] References Cited

U.S. PATENT DOCUMENTS

| | | | |
|---|---|---|---|
| 2,821,066 | 1/1958 | Clarke et al. | 60/39.36 |
| 3,684,186 | 8/1972 | Helmrich . | |
| 3,703,259 | 11/1972 | Sturgess et al. | 60/748 |
| 3,854,285 | 12/1974 | Stenger et al. | 60/756 |
| 3,905,192 | 9/1975 | Pierce et al. . | |
| 3,915,387 | 10/1975 | Caruel et al. . | |
| 3,917,173 | 11/1975 | Signh . | |
| 3,919,838 | 11/1975 | Armstrong et al. | 60/39.27 |
| 3,927,520 | 12/1975 | Arvin et al. . | |
| 3,927,835 | 12/1975 | Gerrard . | |
| 3,958,413 | 5/1976 | Cornelius et al. | 60/39.23 |
| 3,980,233 | 9/1976 | Simmons et al. . | |
| 4,044,553 | 8/1977 | Vaught . | |
| 4,070,826 | 1/1978 | Stenger et al. . | |
| 4,085,579 | 4/1978 | Holzapfel et al. | 60/39.23 |
| 4,105,163 | 8/1978 | Davis, Jr. et al. . | |
| 4,162,611 | 7/1979 | Caruel et al. . | |
| 4,198,815 | 4/1980 | Bobo et al. . | |
| 4,255,927 | 3/1981 | Johnson et al. | 60/39.23 |

*Primary Examiner*—Louis J. Casaregola

*Attorney, Agent, or Firm*—J. Richard Konneker; Albert J. Miller

[57] ABSTRACT

A variable geometry combustor for use in a gas turbine propulsion engine.

14 Claims, 10 Drawing Figures

FIG. 4
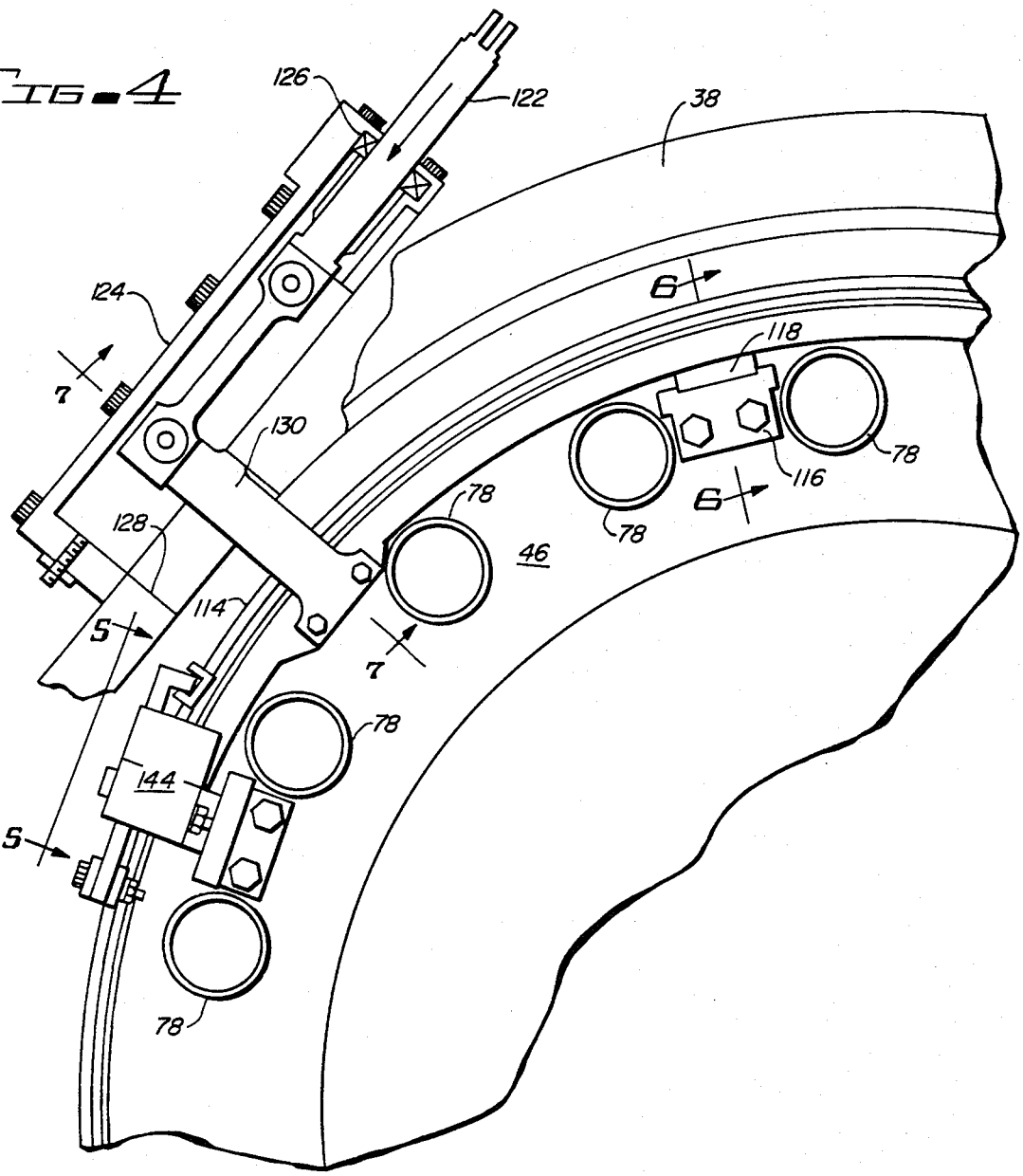
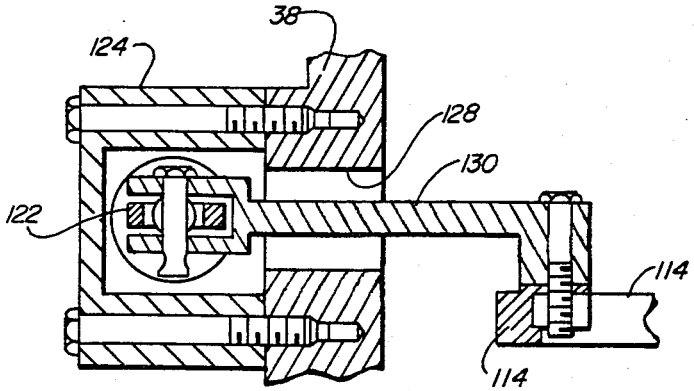
FIG. 7
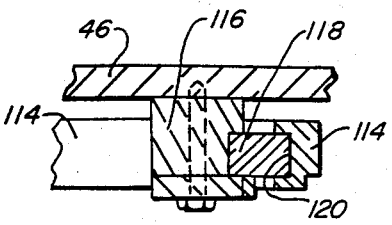
FIG. 6

GAS TURBINE ENGINE VARIABLE GEOMETRY COMBUSTOR APPARATUS

The Government has rights in this invention pursuant to Contract No. F33615-79-C-2000 awarded by the U.S. Air Force.

CROSS-REFERENCE TO RELATED APPLICATION

This application discloses subject matter common to that in copending patent application Ser. No. 400,578 filed July 22, 1982 now U.S. Pat. No. 4,497,170 entitled "Actuation System for a Variable Geometry Combustor" filed concurrently herewith.

BACKGROUND OF THE INVENTION

The present invention relates generally to combustors utilized in gas turbine propulsion engines. More particularly, this invention provides variable geometry combustor apparatus, and associated methods, for imparting significantly improved stability and ignition performance to high-temperature rise combustion systems employed in advanced gas turbine aircraft propulsion engines.

Continuing evolution and improvements in combustor design have resulted in highly efficient fixed geometry combustors for conventional aircraft gas turbine propulsion engines. However, it is well known that such conventional combustors have significant limitations and disadvantages when utilized in the propulsion engines of ultra-high performance aircraft operating within expanded altitude-mach number flight envelopes. Among the more critical of these recognized combustor deficiencies arising from flight envelope expansion are combustion instability, high altitude relight difficulties and ground ignition problems at low ambient temperatures.

Accordingly, it is an object of the present invention to provide improved combustor apparatus, and associated methods, which eliminate or minimize above-mentioned and other limitations and disadvantages associated with conventional fixed geometry combustors.

SUMMARY OF THE INVENTION

In carrying out principles of the present invention, in accordance with a preferred embodiment thereof, a gas turbine propulsion engine is provided with a specially designed variable geometry combustor which is operable to significantly expand the altitude-mach number flight envelope within which the engine may be operated without experiencing the combustor lean instability and relight problems associated with conventional fixed geometry combustors.

The variable geometry combustor constituting the preferred embodiment is of an annular, reverse flow configuration, having a hollow, annular combustor liner which is surrounded by an intake plenum that receives high pressure discharge air from the engine's compressor section. The combustor liner has an annular upstream end wall and an annular interior wall spaced therefrom in a downstream direction. Together with the annular liner sidewalls these axially spaced liner walls define within the liner interior an annular air inlet plenum which communicates with the main combustor intake plenum through a circumferentially spaced series of liner slots positioned around the outer liner periphery between the upstream end wall and the interior wall of the liner.

Projecting axially inwardly through the liner end wall, the liner inlet plenum and the interior liner wall are a circumferentially spaced series of piloted, air blast fuel nozzles for injecting fuel into a dome portion of the liner interior which extends downstream from the annular interior liner wall. Compressor discharge air entering the liner plenum through the slotted inlet openings is forced into the liner dome area through air swirler means carried by the interior wall and circumscribing each of the fuel nozzles. A portion of this entering air is also forced axially through skirted cooling passages extending along the dome portion of the liner interior and communicating with the liner inlet plenum.

Immediately downstream from the liner dome portion are a circumferentially spaced series of liner wall orifices for admitting primary combustion air into the liner interior. Further downstream are a circumferentially spaced series of aft end openings, formed through the radially outer liner sidewall, through which the liner interior and the main combustor intake plenum communicate.

To effectively vary the geometry of the combustor, means are provided for selectively closing off the liner's slotted inlet plenum openings while permitting air inflow through the aft end openings, or closing off the aft end openings while permitting air inflow through the slotted lines inlet plenum openings. This ability to close off either the aft end openings or the liner plenum inlet openings affords the combustor substantially improved combustion stability and relight capabilities.

More specifically, during ground starts of the engine, the aft end openings are unblocked, the liner inlet plenum openings are closed off, and the nozzles are staged to their pilot fuel spray mode. The closure of the liner plenum inlet openings prevents inward airflow through the air swirlers and also prevents the flow of cooling air through the skirted cooling passages. This mode of operating the combustor, which is also utilized to effect high altitude relights of the combustor, simultaneously maximizes the fuel richness in the liner dome area and minimizes the heat transfer outwardly through the walls thereof. By effectively elevating both the dome area combustion temperature and the fuel richness in the dome, the operating range within which the combustion process within the combustor may be sustained, and rapidly and reliably initiated, is substantially expanded.

After startup of the engine is initiated in this manner, the engine is brought to within its normal power output range by unblocking the liner inlet openings and closing off the aft end openings—establishing both swirler air inflow and dome cooling airflow. Should the need arise for a high altitude restart of the engine, the aft end and liner plenum inlet openings are respectively unblocked and closed off as previously described. During restart, instead of conventionally externally bleeding excess compressor discharge air from the engine, such excess air is forced inwardly through the pressure balancing openings, outwardly through the combustor outlet, and across the turbine section of the engine to increase the "windmill" restarting forces thereon. Coupled with the previously described dome swirler and cooling air control, this unique use of compressor bleed air further enhances the high altitude restart capabilities of the engine.

BRIEF DESCRIPTION OF THE DRAWINGS

FIG. 4 is a fragmentary cross-sectional view taken through the combustor along line 4—4 of FIG. 3;

FIG. 6 is a cross-sectional view through the actuation system taken along line 6—6 of FIG. 4;

FIG. 7 is an enlarged cross-sectional view through the actuation system taken along line 7—7 of FIG. 4.

DETAILED DESCRIPTION

Figure 1:
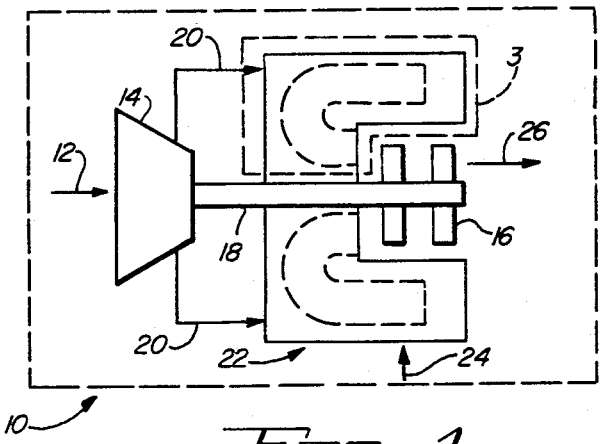
FIG. 1 is a greatly simplified schematic diagram of a gas turbine aircraft propulsion engine having a variable geometry combustor and associated actuation system which embody principles of the present invention.

Schematically illustrated in FIG. 1 are the primary components of a gas turbine propulsion engine 10 which embodies principles of the present invention. During operation of the engine, ambient air 12 is drawn into a compressor 14 which is spaced apart from and rotationally coupled to a bladed turbine section 16 by an interconnecting shaft 18. Pressurized air 20 discharged from compressor 14 is forced into an annular, reverse flow combustor 22 which circumscribes the turbine section 16 and an adjacent portion of shaft 18. The air 20 is mixed within the combustor with fuel 24, the resulting fuel-air mixture being continuously burned and discharged from the combustor across turbine section 16 in the form of hot, expanded gas 26. This expulsion of the gas 26 simultaneously drives the turbine and compressor, and provides the engine's propulsive thrust.

Figure 2:
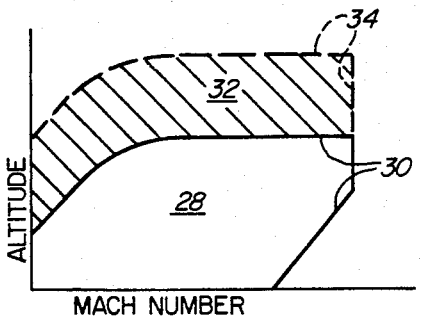
FIG. 2 is a graph illustrating the expanded flight envelope in which the engine may be operated due to the substantially improved combustion stability and ignition capabilities of the combustor.

Conventional combustors used in aircraft jet propulsion engines are of fixed geometry construction and are designed to be operated only within a predetermined altitude-mach number flight envelope such as envelope 28 bounded by the solid line 30 in the graph of FIG. 2. If an attempt is made to operate the conventional combustor at higher altitudes or lower mach numbers than those within envelope 28 (i.e., within, for example, the cross-hatched area 32 bounded by line 30 and dashed line 36 in FIG. 2), the lean stability and altitude relight capability of the combustor are adversely affected. More specifically, if a conventional, fixed geometry combustor were to be operated within the representative flight envelope expansion area 32, the combustion process in the combustor would be subject to abrupt, unintended extinguishment, causing an equally abrupt power loss. Compounding this rather serious problem, substantial difficulty would normally be encountered in relighting the combustor until the aircraft dropped back into the normal flight envelope 28.

Not only is the upper boundary of a gas turbine propulsion engine's flight envelope limited by conventional fixed geometry combustor apparatus as just described, but certain other previously necessary combustor design compromises limit the engine's performance—even within the design flight envelope 28. One such limitation arising from the use of fixed geometry high temperature rise combustors is the occurrence of engine ground starting difficulty—especially at low ambient temperatures.

As will now be described with reference to FIGS. 3–8, the combustor 22 of the present invention is of a unique, variable geometry construction which permits the engine 10 to be efficiently and reliably operated within the substantially expanded flight envelope 28, 32 without these lean instability, altitude relight, and ground start problems of fixed geometry combustors.

Figure 3A:
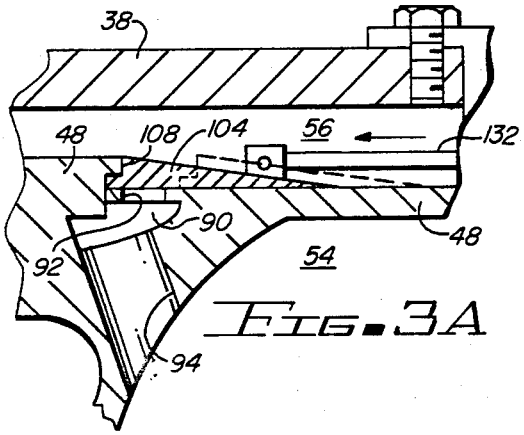
FIG. 3A is an enlarged view of area 3A of FIG. 3 and illustrates a first sealing valve member of the actuation system moved to its closed position.
Figure 3B:
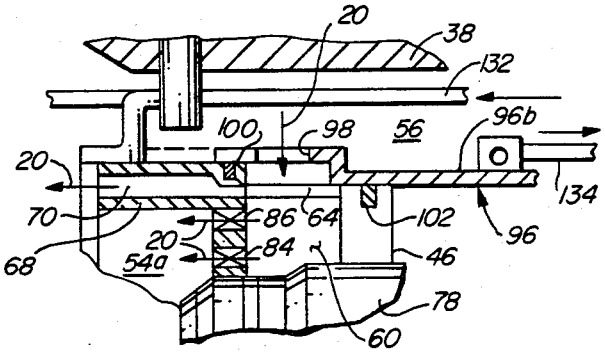
FIG. 3B is an enlarged view of area 3B of FIG. 3 and illustrates a second sealing valve member of the actuation system moved to its open position.
Figure 5:
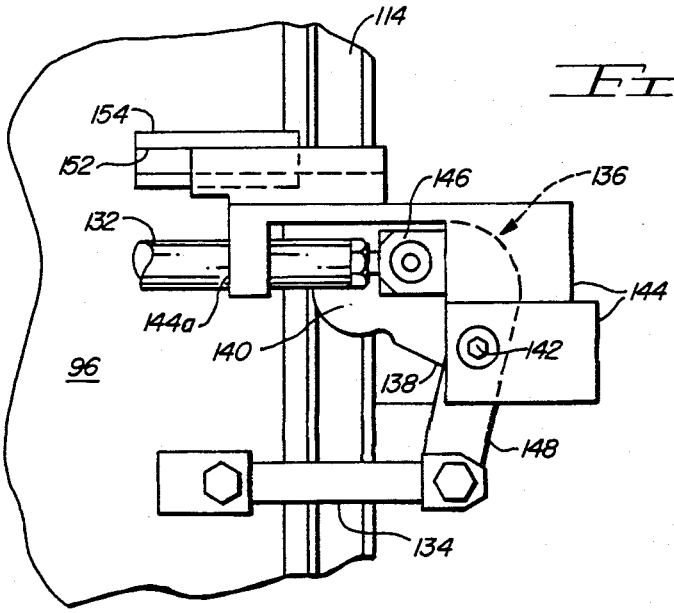
FIG. 5 is an enlarged elevational view of a portion of the actuation system taken along line 5—5 of FIG. 4.
Figure 3:
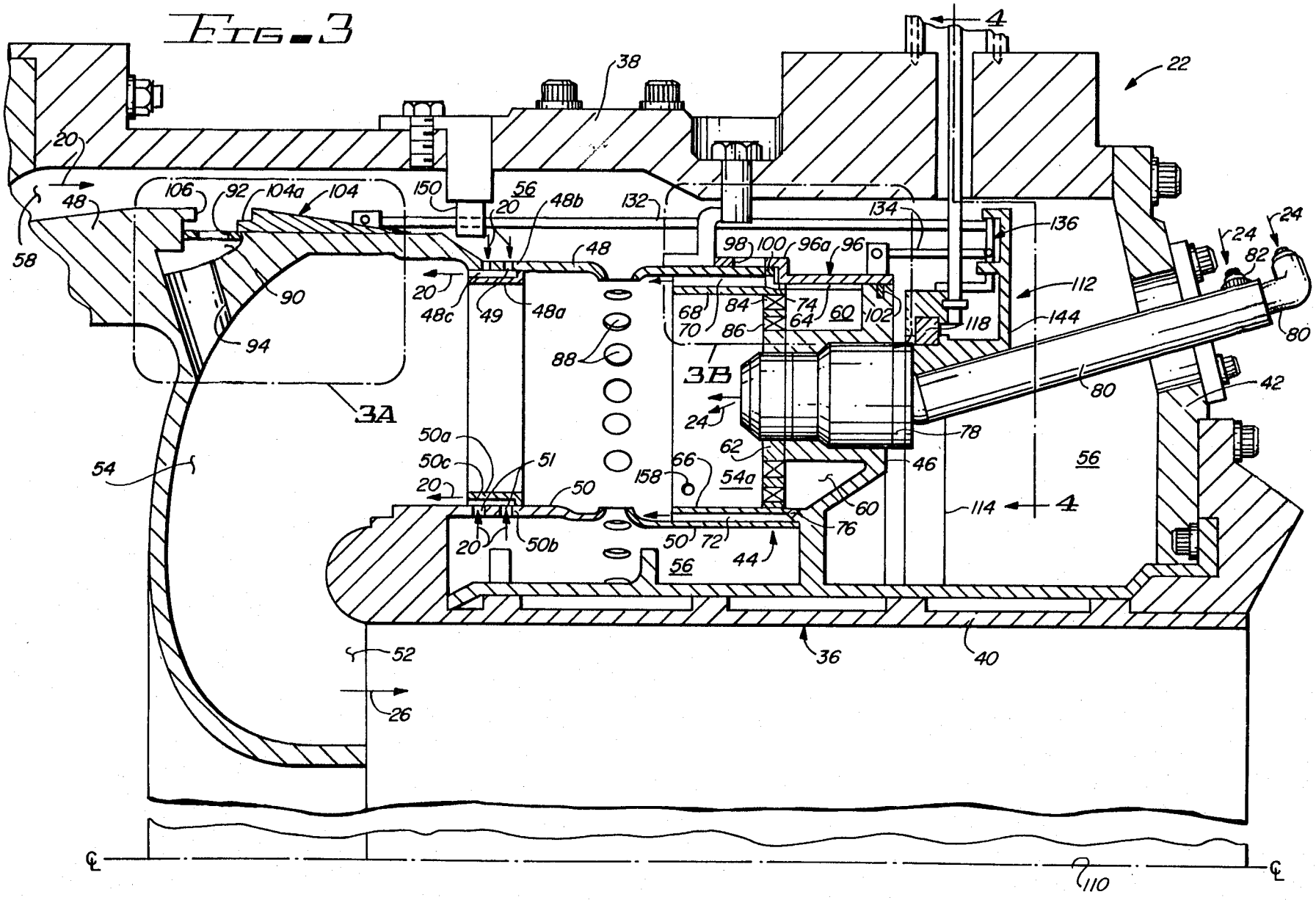
FIG. 3 is a greatly enlarged cross-sectional view through area 3 of the combustor of FIG. 1, with portions of the combustor interior details being omitted for illustrative clarity.

Referring to FIG. 3, the combustor 22 includes a hollow, annular outer housing 36 having an annular radially outer sidewall 38 and an annular, radially inner sidewall 40 spaced apart from and connected to sidewall 38 by an annular upstream end wall 42. Positioned coaxially within the housing 36 is an upstream end portion of an annular, hollow combustor liner 44 having a reverse flow configuration. Liner 44 has an annular upstream end wall 46 spaced axially inwardly from the housing end wall 42, and annular radially outer and inner sidewalls 48, 50 which extend leftwardly (as viewed in FIG. 3) from liner end wall 46 and then curve radially inwardly through a full 180°. At their downstream termination, the liner sidewalls 48, 50 define an annular discharge opening 52 through which the hot discharge gas 26 is expelled from the interior or combustion flow passage 54 of liner 44.

The interior of housing 36 defines an intake plenum 56 which circumscribes the upstream end portion of liner 44 as indicated in FIG. 3. Compressor discharge air 20 is forced into plenum 56 through an annular inlet opening 58 which circumscribes the liner 44 and is positioned at the left end of combustor 22. A portion of this pressurized air is used to cool the liner sidewalls 48, 50 during combustor operation. Although these sidewalls are, for the most part, shown in FIG. 3 as being of solid construction for the sake of clarity, they are actually of a conventional "skirted" construction. More specifically, except for an area of the combustor liner described subsequently, the sidewalls 48, 50 have, along axially adjacent portions of their lengths, overlapping, radially spaced inner and outer wall segments 48*a*, 48*b* and 50*a*, 50*b* (only one set of such inner and outer wall segments being representatively illustrated in FIG. 3). To cool the walls 48, 50 air 20 is forced inwardly through openings 49, 51 formed respectively through the wall segments 48*b*, 50*b*. The entering air impinges upon the inner wall segments 48*a*, 50*a* and enters the combustion flow passage 54, in a downstream direction, through exit slots 48*c*, 50*c* formed between the skirted wall segments.

At the upstream end of the liner 44 is an annular liner inlet plenum 60 which is positioned axially between the liner end wall 46 and an annular liner interior wall 62 which is axially spaced in a downstream direction from the liner end wall 46. The plenum 60 opens radially outwardly through the outer liner sidewall 48 through a circumferentially spaced series of inlet slots 64 (only one of which is shown in FIG. 3) formed through sidewall 48. Extending downstream from the interior wall 62 is a dome portion 54*a* of the combustion flow passage 54 which is radially bounded by inner and outer annular cooling skirts 66, 68. Cooling skirts 66, 68 are spaced inwardly from the inner and outer liner sidewalls 50, 48, respectively, and define with the liner sidewalls axially extending cooling passages 70, 72 which open in a downstream direction into the combustion flow passage 54 as indicated in FIG. 3. Cooling passage 70 communicates at its upstream end with the liner inlet plenum 60 through a circumferentially spaced series of air passages 74 formed through the liner interior wall 62, while the annular cooling passage 72 communicates with the plenum 60 through a circumferentially spaced series of air flow passages 76 also extending through the interior wall 62. In a manner subsequently described, compressor discharge air 20 is selectively admitted to the liner plenum 60 and is forced axially through the annular flow passages 70, 72 and into the combustion flow passage 54 to thereby cool the inner wall surfaces of the liner dome portion 54*a* similarly to the cooling of the inner liner wall surfaces achieved by the cooling skirts 48*a*, 50*a*.

To inject fuel 24 into the dome area 54*a*, a circumferentially spaced series of fuel nozzles 78 are utilized. The nozzles 78 project axially inwardly through the liner end wall 46, the liner plenum 60, and the liner interior wall 62 into the dome area 54*a* (see also FIG. 4). Each of these fuel nozzles is of a piloted air blast type, being supplied by a pair of fuel lines 80, 82 extending inwardly through the housing end wall 42. At the inner end of each of the nozzles is a pressure atomizing fuel outlet (not specifically illustrated) and an air blast fuel spray outlet (also not specifically illustrated). In a conventional manner the nozzles may be staged to deliver fuel through either of the atomizing or air blast outlets.

Coannularly circumscribing each of the nozzles 78, and carried by the liner interior wall 62, are a pair of annular air swirlers 84, 86 which provide communication between the liner dome area 54*a* and the liner plenum 60 radially inwardly of the cooling skirts 66, 68. Primary combustion air is admitted to the flow passage 54 through a circumferentially spaced series of inlet orifices 88 positioned immediately downstream from the dome area 54*a*. At the left end of the liner 44 is an annular plenum 90 which opens outwardly into the housing plenum 56 through a circumferentially spaced series of slots 92 formed through the liner side wall 48, and communicates with the combustion flow passage 54 through a circumferentially spaced series of inlet passages 94 extending inwardly through the sidewall 48.

The previously described structure of the combustor 44 uniquely permits its geometry to be effectively varied by selectively blocking or unblocking the inlet slots 64, 92, in a predetermined manner which will now be described, to substantially enhance the lean stability and starting capabilities of the engine 10.

Figure 8:
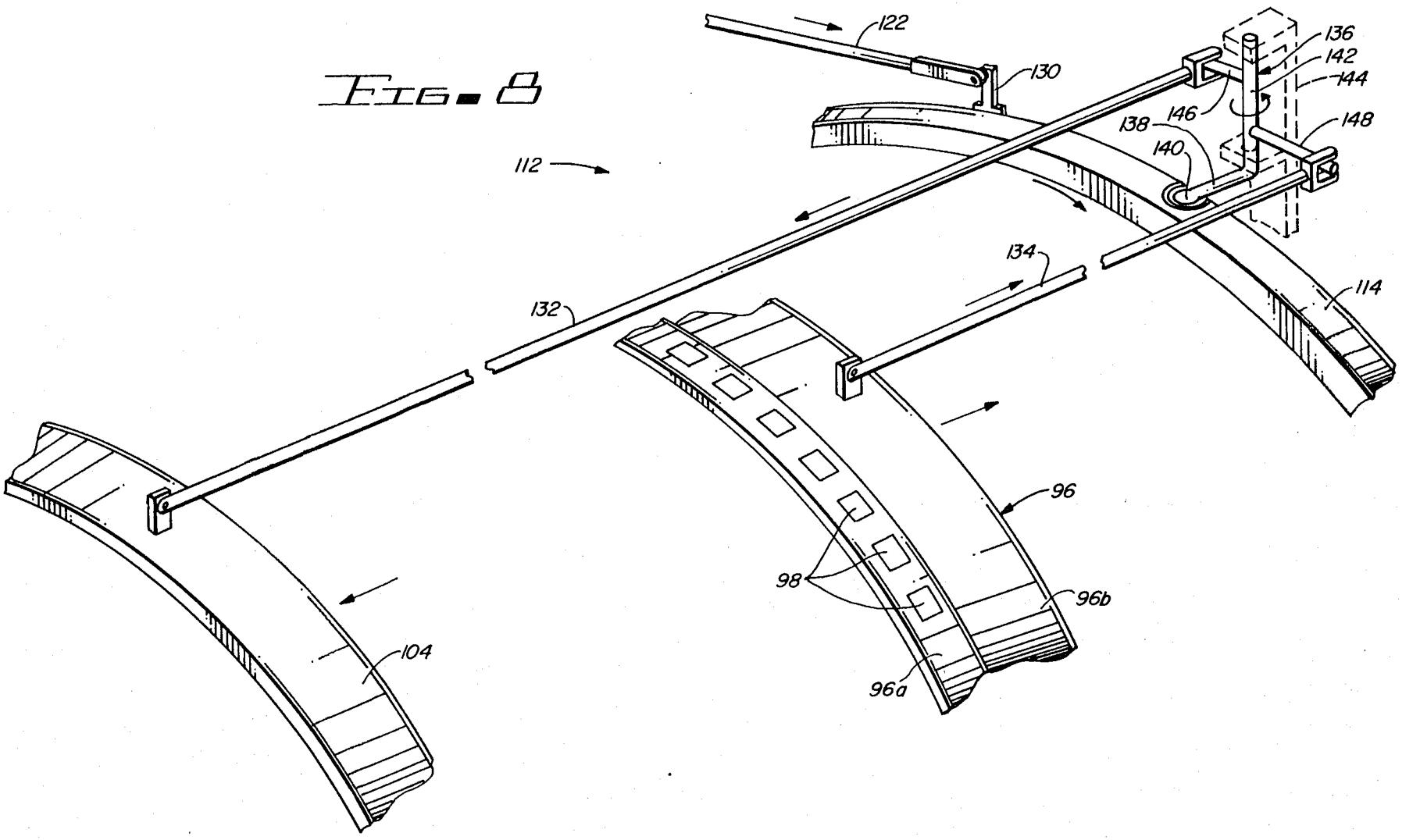
FIG. 8 is a fragmentary isometric illustration of a portion of the actuation system which schematically depicts the selective movement of various of its components.

Referring now to FIGS. 3, 3A, 3B and 8, to selectively block and unblock the liner plenum inlet slots 64, a first sealing member in the form of a valve ring 96 is provided. Ring 96 coaxially circumscribes and outwardly overlies an upstream end portion of the combustor liner 44 as best illustrated in FIG. 3. Ring 96 is axially movable relative to the combustor liner between a closed position illustrated in FIG. 3, and an open position illustrated in FIG. 3A. A left or forward axial portion 96*a* of ring 96 is radially outwardly enlarged and has formed therethrough a circumferentially spaced series of inlet slots 98 (FIG. 8). This forward portion 96*a* of the ring 96 is slidably and sealingly engaged by a piston ring 100 carried by the outer liner wall 48, while the right or rear portion 96*b* of ring 96 is slidably and sealingly engaged by a piston ring 102 which is carried by the liner end wall 46.

At the left end of the combustor liner a second sealing member 104 is provided for selectively blocking and unblocking the inlet slots 92. Ring 104 coaxially circumscribes and outwardly overlies the liner sidewall 48 for slidable axial movement therealong between a closed position indicated in FIG. 3 and an open position shown in FIG. 3A. With the sealing ring 104 in its closed position, the inlet ports 92 are blocked to preclude entry therethrough of compressor discharge air 20, an annular lip 104*a* on the ring 104 cooperating with an overlying annular lip 106 on the liner side wall 48 to create a labyrinth seal 108 between ring 104 and side wall 48, as shown in FIG. 3A, with ring 104 in its closed position.

With the sealing ring 96 in its closed position, the rear axial portion 96*b* thereof blocks off the inlet slots 64 (FIG. 3) to preclude entry of compressor discharge air 20 into the liner inlet plenum 60, the piston rings 100, 102 providing annular air flow seals between the combustor liner and the ring 96 adjacent the opposite ends of the plenum 60.

Referring now to FIGS. 3 and 8, the sealing rings 96, 104 are selectively moved in axially opposite directions (i.e. parallel to the center line or axis 110 of the combustor) between their previously described open and closed positions by a novel actuation system 112. The actuation system includes an actuation or unison ring 114 which is positioned coaxially within the housing plenum 56 immediately adjacent the outer ends of the fuel nozzles 78. The actuation ring 114 is rotatably supported within the plenum 56 by a circumferentially spaced series of bearing support brackets 116 (only one of such brackets being illustrated in FIG. 4) which are positioned between adjacent nozzles 78 and externally secured to the liner end wall 46. Each of these brackets 116 carries a carbon bearing block 118 which is slidably received in a circumferential channel 120 (see FIG. 6) formed in the radially inner surface of the unison ring 114, thereby facilitating rotation of ring 114 within the plenum 56.

Selective rotation of the unison ring 114 is achieved by the axial movement of a control rod 122 which extends into a small housing 124, through seal means 126 carried by such housing, which is externally secured to the outer housing sidewall 38 over an opening 128 extending therethrough. Control rod 122 extends lengthwise generally tangentially to the outer surface of housing sidewall 38 and perpendicularly to the combustor axis. The inner end of the control rod 122 is pivotally secured to one end of a connecting rod 130 which extends radially inwardly through the sidewall opening 128 and is secured at its inner end to the unison ring 114. As viewed in FIG. 4, inward axial movement of the control rod 122, which may be achieved by conventional control means (not illustrated) positioned outside the combustor housing, moves the connecting rod 130 to the left within the opening 128 and causes a counterclockwise rotation of the unison ring 114. In a similar manner, an outward axial movement of the control rod causes a clockwise rotation of the unison ring.

Such selective rotation of the unison ring 114 is utilized to cause the opposite axial motion of the sealing rings 96, 104 by linking means in the form of four circumferentially spaced sets of actuating rods 132, 134 (only one such rod set being illustrated in FIGS. 3 and 8) which extend axially within the housing sidewalls 48, 38 and are connected to the unison ring 114 by means of four circumferentially spaced bell crank members 136.

Referring again to FIGS. 3 and 8, each of the four bell crank members 136 has a base leg portion 138 which is pivoted at its outer end to the unison ring 114 (as at 140) and extends from its pivot point, in a generally axial direction toward the housing end wall 42, to a radially outwardly directed trunk portion 142 which is pivoted in a support bracket 144 as indicated in phantom in FIG. 8. Each of the four support brackets 144 is secured to the liner end wall 46 between an adjacent pair of nozzles 78 as can be best seen in FIG. 4. Like the previously described bearing brackets 116, each of these support brackets 144 also carries a carbon bearing block 118 (see FIG. 3) which slidably engages the inner surface of the unison ring 114.

Extending transversely in opposite directions from the bell crank member's trunk portion 142 are a pair of control arms 146, 148 (FIG. 8). The outer end of each arm 146 is pivotally connected to one end of an actuating rod 132 which is secured at its opposite end to the sealing ring 104. In a similar manner, the outer end of each arm 148 is pivotally connected to one end of an actuating rod 134, the other end of such actuating rod 134 being secured to the sealing ring 96.

As viewed in FIG. 8, when the control rod 122 is moved axially inwardly, the unison ring is rotated in a clockwise direction. This pivots the bell crank member trunk portion 142 in a counter-clockwise direction within the suppport bracket 144. This, in turn, simultaneously causes leftward axial motion of each of the actuating rods 132, and rightward axial motion of each of the actuating rods 134, thereby simultaneously moving the sealing ring 104 leftwardly towards its closed position, and moving the sealing ring 96 rightwardly towards its open position. Outward axial motion of the control rod 122 causes opposite axial movement of each of the sealing rings 96, 104.

To laterally stabilize the much longer actuating rods 132, each of them is slidably extended through a journal portion **144*a* of its associated support bracket 144 (FIG. 5) and an additional journal support 150 (FIG. 3) carried by the outer housing sidewall 38. Such journalling also rotationally stabilizes the sealing ring 104, thereby assuring a smooth sliding motion thereof along the liner sidewall 48. A similar rotational stability is also provided to the sealing ring 96 by means of a channel 152 (FIG. 5) which is formed in a guide member 154 secured to the sealing ring 96, the channel 152 slidably receiving a downturned lip portion 156 of support bracket 144 (see also FIG. 4**).

OPERATION OF COMBUSTOR 22

During normal operation of the combustor 22, the actuation system 112 is utilized to move the sealing ring 96 to its open position (FIG. 3B) and to simultaneously move the sealing ring 104 to its closed position (FIG. 3A). With the sealing rings in their normal operating positions, compressor discharge air 20 in the housing plenum 56 is forced inwardly through the sealing ring inlet slots 98 into the liner plenum 60. From the plenum 60 entering air 20 is forced outwardly through the dome wall cooling slots 70, 72 and is also forced into the combustor dome portion **54*a* through the annular air swirlers 84, 86 in a swirling flow pattern. The entering swirl air is mixed with the fuel and fuel-air mixtures discharged from the nozzles 78, further mixed with the primary combustion air entering through the primary orifices 88**, and continously burned.

The fuel richness within the combustor dome area **54*a* may be selectivley varied both by variably staging the fuel nozzles 78 and by moving the sealing ring 96 toward its closed position, thereby blocking off a portion of the sealing ring inlet slots 98. Such movement of the sealing ring 96 toward its closed position simultaneously reduces air flow through the wall cooling slots 70, 72 and through the swirler plates 84, 86. This, in turn, reduces the dome wall cooling, thereby elevating the combustion temperature in the dome area, and reduces the total amount of swirler air entering the dome area. By virtue of this unique ability to simultaneously vary both the fuel richness and the dome wall temperature, the overall combustion stability of the combustor 22 is substantially improved compared to conventional fixed geometry combustors, thus permitting reliable and efficient normal operation of the engine 10 within the expanded flight envelope portion 32 of FIG. 2**.

Should combustion in the combustor 22 be extinguished at altitude, the combustion is easily and rapidly reinitiated, even in the expanded flight envelope portion 32, by utilizing the actuation system 112 to move the sealing rings 96, 104 to their fully closed and fully opened positions, respectively, as depicted in FIG. 3. With the sealing ring 96 in its fully closed position, all swirler air flow to the dome area **54*a*, and all cooling air flow through the skirted dome cooling slots 70, 72 is terminated. The nozzles 78 are then staged to their pilot position, and fuel 24 injected into the dome from the pressure atomizing outlets of the nozzles 78 is mixed with primary combustion air entering the orifices 88. This mixture is ignited by conventional igniter means 158** to reestablish combustion.

It is important to note that with the sealing ring 96 in its fully closed position, and the nozzles staged to their pilot conditions, the fuel richness within the dome area 54 is maximized. Moreover, at the same time, the dome cooling is minimized, thereby maximizing the dome combustion temperature. These cooperating features of the improved combustor 22 provide greatly improved altitude relight capabilities, thereby adding yet another measure of safety and reliability to the combustor when it is operated within the expanded flight envelope zone 32.

The altitude restart capabilities of the combustor 22 are further enhanced when the sealing ring 104 is brought to its fully opened position by the actuation system 112. During altitude relight procedures with conventional fixed geometry combustors, excess compressor discharge air is intentionally bypassed around the combustor and bled off to atmosphere. However, in the present invention, such compressor discharge air is uniquely utilized to assist in the altitude restart procedure. More specifically, with the sealing ring 104 in its fully opened position, this previously wasted excess compressor discharge air is forced inwardly through the inlet slots 92, the plenum 90 and the inlet passages 94 into the combustion flow passage 54. The entering compressor discharge air is then forced outwardly through the combustor outlet opening 52 and across the bladed turbine section 16 to greatly assist in the "windmill" restarting of the engine 10.

The previously described maximization of the fuel richness and wall temperature within the dome area **54*a*** not only improves the altitude relight and lean stability characteristics of the engine 10 but also substantially improves its ground start capabilities—especially in low ambient temperature conditions.

In summary, the present invention provides improved combustor apparatus, and associated operating methods, which eliminate or substantially reduce the stability and relight problems commonly associated with conventional fixed geometry combustors.

The foregoing detailed description is to be clearly understood as given by way of illustration and example only, the spirit and scope of this invention being limited solely by the appended claims.

What is claimed is:

1. Variable geometry combustor apparatus comprising:

(a) a housing;

(b) a combustion liner at least partially enveloped by said housing and defining therewith a plenum in said housing for receiving pressurized air from a source thereof, said liner having:

(1) an upstream end wall positioned within said housing plenum, (2) an interior wall positioned downstream from said end wall, (3) a sidewall portion extending downstream from said end wall within said housing, said sidewall portion defining with said interior wall and said end wall an inlet plenum within said liner, and further defining a combustion flow passage extending downstream from said interior wall, (4) inlet opening means for admitting pressurized air from said housing plenum into said liner plenum, (5) swirler means for flowing pressurized air entering said liner plenum into said combustion flow passage in a swirling flow pattern, (6) cooling passage means, communicating with said liner plenum and extending within said flow passage along a dome portion thereof positioned at the upstream end of said flow passage, for flowing pressurized air from said liner plenum along said sidewall portion to cool the same, and (7) primary air inlet opening means, positioned downstream from said dome portion, for flowing pressurized air from said housing plenum into said combustion flow passage;

(c) nozzle means for injecting fuel into said dome portion for mixture and combustion with air entering said flow passage; and (d) means for selectively varying air inflow through said liner plenum inlet opening means to thereby simultaneously regulate air flow through said swirler means and said cooling passage means.

2. The combustor apparatus of claim 1 wherein said means (d) comprise means for selectively blocking and unblocking said inlet opening means.

3. The combustor apparatus of claim 1 wherein said nozzle means extend through said interior wall into said combustion flow passage, and wherein said swirler means are carried by said interior wall and circumscribe said nozzle means.

4. The combustor apparatus of claim 1 wherein said liner further has additional inlet opening means positioned downstream from said primary air inlet opening means, and wherein said combustor apparatus further comprises means for selectively varying air inflow through said additional inlet opening means in generally inverse proportion to the variance in air inflow through said first-mentioned inlet opening means.

5. The combustor apparatus of claim 4 wherein said means for selectively varying air inflow through said first-mentioned and additional inlet opening means comprise means for selectively blocking or unblocking such inlet opening means.

6. The combustor apparatus of claim 1 wherein said liner further comprises cooling skirt means extending along said combustion flow passage, said cooling skirt means cooperating with said sidewall portion to define said cooling passage means.

7. A variable geometry combustor comprising:

(a) an annular housing;

(b) an annular combustor liner extending coaxially within said housing and defining therewith an inlet plenum within said housing for receiving pressurized air from a source thereof, said liner having:

(1) an annular upstream end wall positioned within said housing plenum, (2) mutually spaced, annular radially inner and outer sidewalls extending in a downstream direction from said end wall, (3) an annular interior wall spaced in a downstream direction from said end wall and dividing the interior of said liner into an inlet plenum between said end and interior walls, and a combustion flow passage extending downstream from said interior wall, said combustion flow passage having a dome portion immediately adjacent said interior wall, (4) a first series of inlet openings for admitting pressurized air from said housing plenum into said liner plenum, (5) a second series of inlet openings for admitting pressurized air from said liner plenum into said combustion flow passage through said interior wall, (6) skirt means defining cooling flow passages communicating with said liner plenum and extending axially along the inner periphery of said dome portion for flowing pressurized air from said liner plenum into said combustion flow passage to thereby cool the inner surface of said dome portion, and (7) swirler means for imparting a swirling flow pattern to air entering said combustion flow passage through said second series of inlet openings;

(c) nozzle means for injecting fuel into said combustion flow passage through said dome portion; and (d) means for selectively varying air inflow through said first series of inlet openings.

8. The combustor of claim 7 wherein said means (d) comprise means for selectively blocking or unblocking said first series of inlet openings.

9. The combustor of claim 8 wherein said first series of inlet openings are circumferentially spaced around the periphery of said radially outer sidewall between said upstream end wall and said interior wall.

10. The combustor of claim 9 wherein said nozzle means extend through said liner plenum and said interior wall, and said swirler means comprise a series of slotted air swirler plates positioned in said second series of inlet openings and circumscribing said nozzle means.

11. The combustor of claim 7 further comprising a third series of inlet openings formed in said liner downstream from said dome portion, and means for selectively varying air inflow through said third series of inlet openings in generally inverse proportion to air inflow variance through said first series of inlet openings.

12. The combustor of claim 11 wherein said air inflow varying means comprise means for selectively blocking or unblocking said first and third series of inlet openings.

13. The combustor of claim 12 further comprising a fourth series of inlet openings formed in said liner between said dome portion and said third series of inlet openings.

14. The combustor of claim 13 wherein said first, third and fourth series of inlet openings extend through said radially outer sidewall in circumferentially spaced arrays.

* * * * *